US006809464B2

(12) United States Patent
Choi et al.

(10) Patent No.: US 6,809,464 B2
(45) Date of Patent: Oct. 26, 2004

(54) FIELD EMISSION DEVICE AND METHOD FOR FABRICATING THE SAME

(75) Inventors: Jun-hee Choi, Kyungki-do (KR); Seung-nam Cha, Seoul (KR); Hang-woo Lee, Kyungki-do (KR)

(73) Assignee: Samsung SDI Co., Ltd., Suwon-si (KR)

( * ) Notice: Subject to any disclaimer, the term of this patent is extended or adjusted under 35 U.S.C. 154(b) by 311 days.

(21) Appl. No.: 09/754,273

(22) Filed: Jan. 5, 2001

(65) Prior Publication Data

US 2001/0006321 A1 Jul. 5, 2001

(30) Foreign Application Priority Data

Jan. 5, 2000 (KR) ..... 2000-362

(51) Int. Cl.[7] ..... H01J 1/02

(52) U.S. Cl. ..... 313/309; 313/495; 313/351; 313/336; 313/346 R; 313/310; 445/24

(58) Field of Search ..... 313/310, 311, 313/495, 346 R, 309, 336, 351, 496, 497; 445/24, 25, 50, 54

(56) References Cited

U.S. PATENT DOCUMENTS

| | | | | |
|---|---|---|---|---|
| 5,290,610 A | | 3/1994 | Kane et al. | |
| 5,836,796 A | | 11/1998 | Danroc | |
| 5,892,321 A | * | 4/1999 | Itoh et al. | 313/336 |
| 5,952,987 A | | 9/1999 | Browning et al. | |
| 6,097,138 A | * | 8/2000 | Nakamoto | 313/309 |
| 6,455,989 B1 | * | 9/2002 | Nakada et al. | 313/309 |
| 6,632,114 B2 | * | 10/2003 | Choi et al. | 445/24 |

FOREIGN PATENT DOCUMENTS

| | | |
|---|---|---|
| WO | WO 99 10974 | 3/1999 |
| WO | WO 98 21736 | 9/1999 |
| WO | WO 98 44526 | 1/2000 |

* cited by examiner

*Primary Examiner*—David V. Bruce
*Assistant Examiner*—Elizabeth Keaney
(74) *Attorney, Agent, or Firm*—Burns, Doane, Swecker & Mathis, L.L.P.

(57) ABSTRACT

A field emission device (FED) and a method for fabricating the FED are provided. The FED includes micro-tips with nano-sized surface features. Due to the micro-tips as a collection of a large number of nano-tips, the FED is operable at low gate turn-on voltages with high emission current densities, thereby lowering power consumption.

15 Claims, 6 Drawing Sheets

FIELD EMISSION DEVICE AND METHOD FOR FABRICATING THE SAME

BACKGROUND OF THE INVENTION

1. Field of the Invention

The present invention relates to a field emission device (FED) operable at low gate turn-on voltages with high emission current densities, and a method for fabricating the FED.

2. Description of the Related Art

An FED panel with a conventional FED is illustrated in FIG. 1. A cathode 2 is formed over a substrate 1 with a metal such as chromium (Cr), and a resistor layer 3 is formed over the cathode 2 with an amorphous silicon. A gate insulation layer 4 with a well 4*a*, through which the bottom of the resistor layer 3 is exposed, is formed on the resistor layer 3 with an insulation material such as $SiO_2$. A micro-tip 5 formed of a metal such as molybdenum (Mo) is located in the well 4*a*. A gate electrode 6 with a gate 6*a* aligned with the well 4*a* is formed on the gate insulation layer 4. An anode 7 is located a predetermined distance above the gate electrode 6. The gate electrode 7 is formed on the inner surface of a faceplate that forms a vacuum cavity in associated with the substrate 1. The faceplate 8 and the substrate 1 are spaced apart from each other by a spacer (not shown), and sealed at the edges. As for color displays, a phosphor screen (not shown) is placed on or near the anode 7.

The conventional FED emits a small amount of electrons from the micro-tip, so that a high gate voltage is required for high emission current densities. However, if the gate voltage level is beyond a predetermined voltage limit, the problems of leakage current and short life time occur. For these reasons, increasing the gate voltage is limited. As an experiment result, the frequency of arcing increases with higher gate voltage level. When an arcing occurs in the FED, damage caused by the arcing is detected at the edges of the gate 6*a* of the gate electrode 6, wherein the gate 6*a* serves as a passageway of electrons. Also, an electrical short occurs between the anode 7 and the gate electrode 6 due to the arcing. As a result, a high anode voltage is applied to the gate electrode 6, thereby damaging the gate insulation layer 4 below the gate electrode 6, and the resistor layer 3 exposed through the well 4*a*. This damage is more likely caused as the gate and anode voltage levels increase.

SUMMARY OF THE INVENTION

To solve the above problems, it is an object of the present invention to provide a field emission display (FED) operable at low gate turn-on voltages with high emission current densities, and a method for fabricating the FED.

According to an aspect of the present invention, there is provided a field emission device (FED) comprising: a substrate; a cathode formed over the substrate; micro-tips having nano-sized surface features, formed on the cathode; a gate insulation layer with wells each of which a single micro-tip is located in, the gate insulation layer formed over the substrate: and a gate electrode with gates aligned with the wells such that each of the micro-tips is exposed through a corresponding gate, the gate electrode formed on the gate insulation layer.

It is preferable that a resistor layer is formed over or beneath the cathode, or resistor layers are formed both over and beneath the cathode in the FED.

According to another aspect of the present invention, there is provided a method for fabricating a field emission device (FED), comprising: forming a cathode, a gate insulation layer with wells, and a gate electrode with gates on a substrate in sequence, and forming micro-tips on the cathode exposed by the wells; forming a carbonaceous polymer layer on the gate electrode, such that the wells having the micro-tips are filled with the carbonaceous polymer layer; and etching the carbonaceous polymer layer and the surface of the micro-tips by plasma etching using a gas mixture containing $O_2$ for the carbonaceous polymer layer, and a gas for the micro-tips, as a reaction gas, so that the micro-tips with nano-sized surface features are formed.

It is preferable that the carbonaceous polymer layer is formed of polyimide or photoresist. The carbonaceous polymer layer may be etched by reactive ion etching (REI). The nano-sized surface features of the micro-tips can be adjusted by varying the etch rates of the carbonaceous polymer layer and the micro-tips. It is preferable that the etch rates are adjusted by varying the oxygen-to-the gas for the micro-chips in the reaction gas, plasma power, or plasma pressure during the etching process.

It is preferable that the micro-tips are formed of at least one selected from the group molybdenum (Mo), tungsten (W), silicon (Si) and diamond.

It is preferable that the reaction gas is a gas mixture of $O_2$ and fluorine-based gas, such as $CF_4/O_2$, $SF_6/O_2$, $CHF_3/O_2$, $CF_4/SF_6/O_2$, $CF_4/CHF_3/O_2$ or $SF_6/CHF_3/O_2$. Alternatively, the reaction gas may be a gas mixture of $O_2$ and chlorine-based gas, such $Cl_2/O_2$, $CCl_4/O_2$, or $Cl_2/CCl_4/O_2$.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 1:
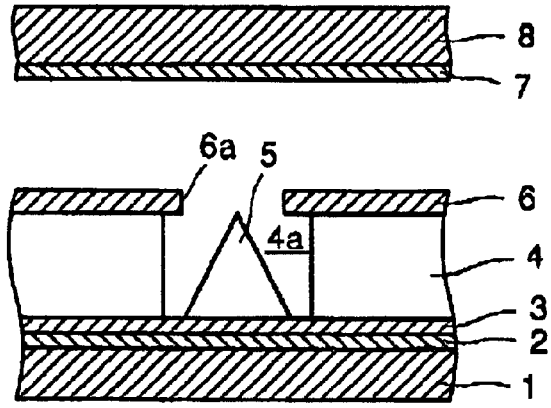
FIG. 1(PRIOR ART)
FIG. 1 is a sectional view of a conventional field emission device (FED)
Figure 2:
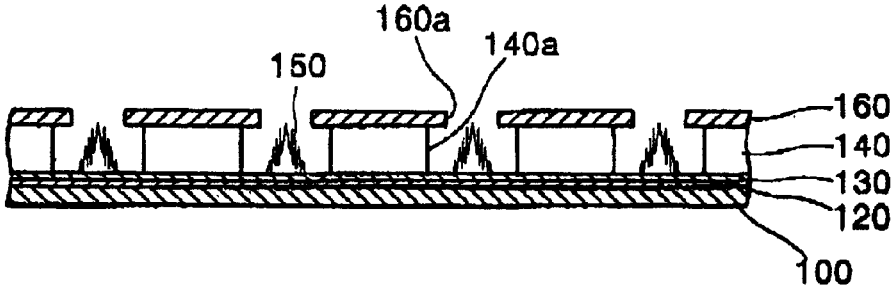
FIG. 2 is a sectional view of a preferred embodiment of a FED according to the present invention.
Figure 2A:
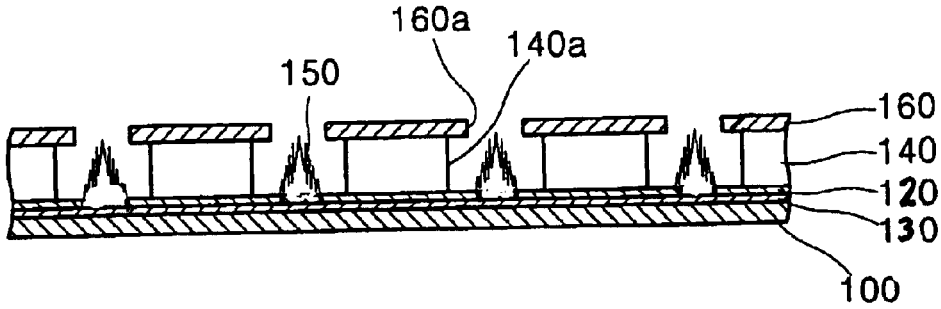
Figure 2B:
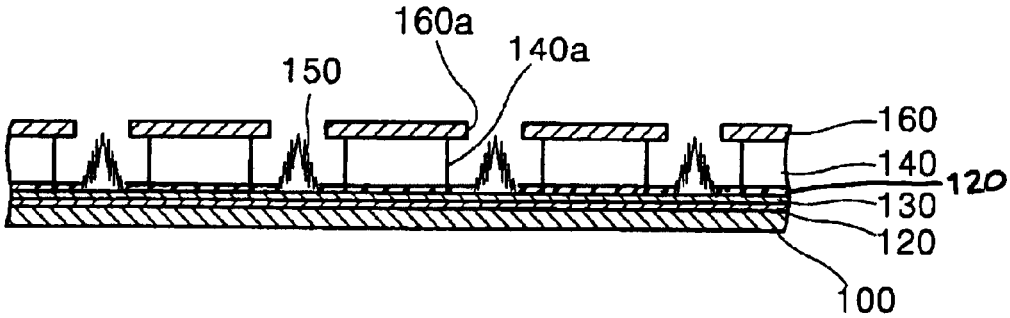

The present invention will now be described more fully with reference to the accompanying drawings, in which preferred embodiments of the invention are shown. Referring to FIG. 2, which is a sectional view of a preferred embodiment of a field emission device (FED) according to the present invention. Referring to FIG. 2, a cathode 120 is formed over a substrate 100 with a metal such as chromium (Cr), and a resistor layer 130 is formed over the cathode 120 with an amorphous silicon. A gate insulation layer 140 with a well 140*a*, through which the bottom of the resistor layer 130 is exposed, is formed on the resistor layer 130 with an insulation material such as $SiO_2$. Use of the resistor layer 130 is optional. In other words, formation of the resistor layer 130 may be omitted so that the cathode 120 is exposed through the well 140*a*. FIGS. 2A and 2B illustrate embodiments in which the resistor layer is above, and above and below, the cathode layer, respectively. A micro-tip 150, which is a feature of the present invention, is formed in the well 140*a* on the resist layer 130 with a metal such as molybdenum (Mo). A micro-tip 150 is a collection of a large number of nano-tips with nano-size surface features. The micro-tip 150 is formed of Mo, W, Si or diamond, or a combination of these materials.

A gate electrode 160 with a gate 160*a* aligned with the well 140*a* is formed on the gate insulation layer 140. An anode electrode (not shown) is formed above the gate electrode 160, and a faceplate (not shown) that forms a vacuum cavity along with the substrate 100 is located outward the anode electrode. The anode electrode is formed on the inner surface of the anode electrode.

In the FED having the configuration described above, since the micro-tip 150 as a collection of a number of nano-tips has nano-sized surface features, a large amount of electrons can be emitted from the micro-tip 150 even at a low gate voltage. In other words, the FED has high emission current densities with low gate voltages, thereby lowering power consumption.

Figure 3:
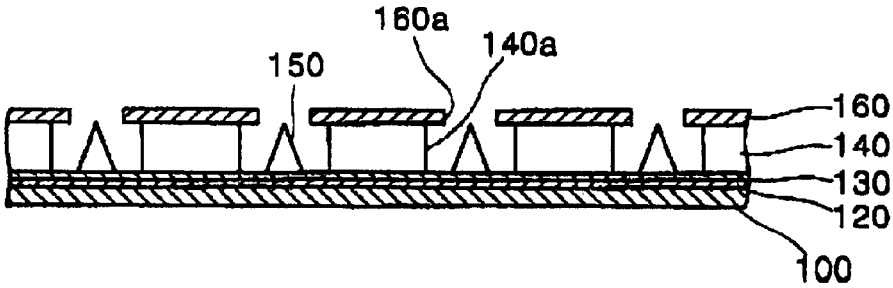
FIGS. 3, 4 and 5 are sectional views illustrating the fabrication processes of an FED according to a preferred embodiment of the present invention.

A preferred embodiment of a method for fabricating a FED according to the present invention will be described. Referring to FIG. 3, a cathode 120, a resistor layer 130, a gate insulation layer 140 with a well 140*a*, and a gate electrode 160 with a gate 160*a* are formed on a semiconductor wafer 100 in sequence by a conventional method, and then a micro-tip 150 is formed in the well 140*a* on the resistor layer 130.

Figure 4:
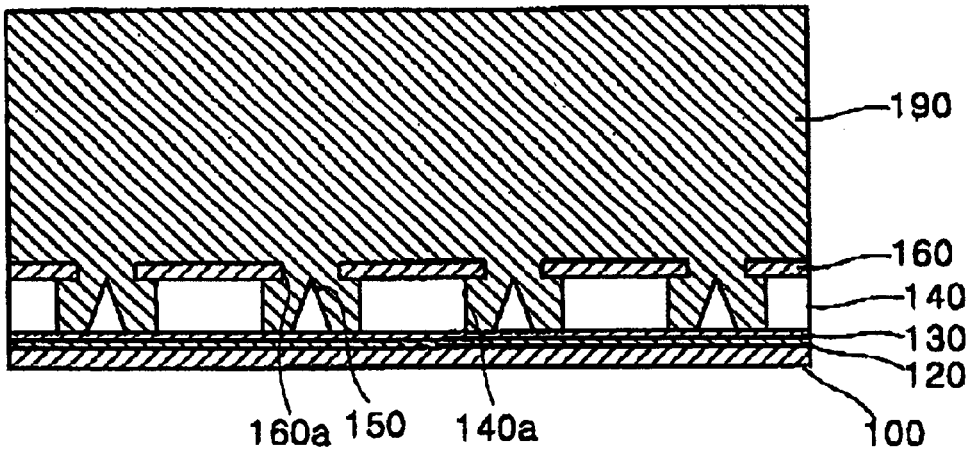

Referring to FIG. 4, polyimide is deposited to have a predetermined thickness over the stack by spin coating, thereby resulting in a carbonaceous polymer layer 190. The carbonaceous polymer layer 190 is formed by spin coating, soft baking and then curing, and the thickness of the carbonaceous polymer layer 190 ranges from 3 to 150 $\mu$m.

Figure 5:
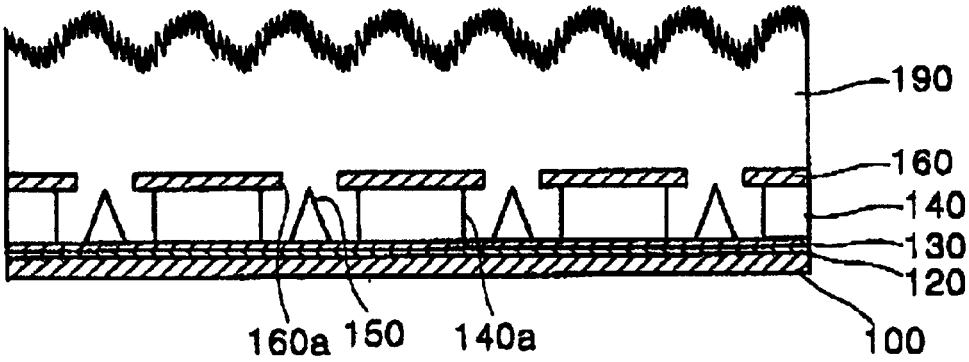

Following this, as shown in FIG. 5, the carbonaceous polymer layer 190 is etched by dry etching, for example, plasma etching, and preferably by reactive ion etching (RIE). When a plasma etching method is applied, a gas mixture containing $O_2$ as a major component, and a fluorine-based gas such as $CF_4$, $SF_6$ or $CHF_3$ may be used as a reaction gas. The gas mixture may be $CF_4/O_2$, $SF_6/O_2$, $CHF_3/O_2$, $CF_4/SF_6/O_2$, $CF_4/CHF_3/O_2$, or $SF_6/CHF_3/O_2$. Alternatively, a gas mixture of $O_2$ and a chlorine-based gas, for example, $Cl_2/O_2$, $CCl_4/O_2$, or $Cl_2/CCl_4/O_2$, can be used as a reaction gas.

Figure 6:
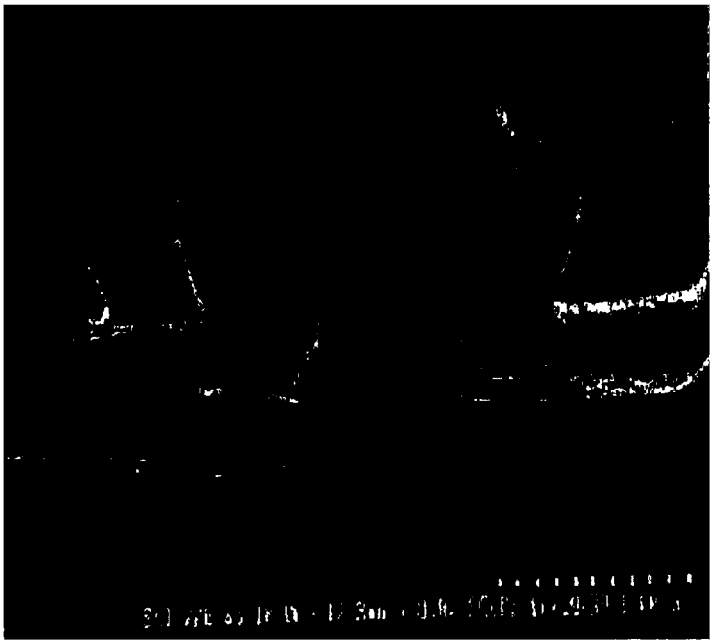
FIG. 6 is a scanning electron microscope (SEM) photo showing a section of the FED fabricated by the inventive method.
Figure 7:
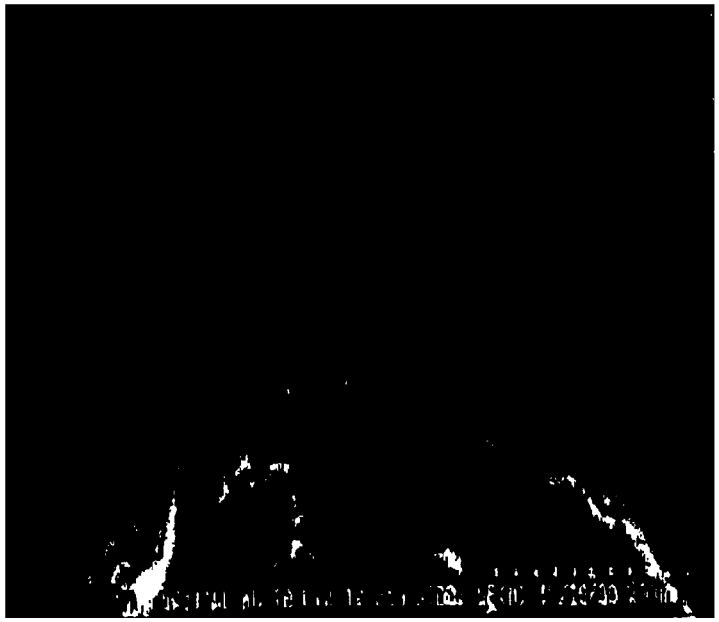
FIG. 7 is a SEM photo showing the configuration of a micro-tip of the FED of FIG. 6.

Carbonaceous polymer layers such as polyimide or photoresist are etched into a grass-like structure by dry plasma etching using $O_2$. The glass-like structure describes rough surface features of the resulting structure due to different etch rates over regions of the carbonaceous polymer layer. The addition of $O_2$ to the fluorine-to chlorine-based gas is for increasing the etch rate of the polyimide layer, such that the micro-tip 150 below the carbonaceous polymer layer can be etched by plasma. The etch rate of the micro-tip 150 by plasma can be adjusted by varying the $O_2$-to-chlorine-based gas, plasma pressure, and plasma power in plasma etching the carbonaceous polymer layer 190. Since the carbonaceous polymer 190 is etched into a grass-like structure, the carbonaceous polymer layer 190 randomly remain over the micro-tip 150. The carbonaceous polymer remaining on the micro-tip 150 acts as a mask for a further etching to the micro-tip 150. As the etching continues, the carbonaceous polymer layer 190 are removed from the micro-tip 150 and the micro-tip 150 is etched. As a result, the original smooth surface of the micro-tip 150 changes into the surface with nano-sized features, as shown in FIG. 2. FIG. 6 is a scanning electron microscope (SEM) photo showing the micro-tip, gate insulation layer, and gate electrode formed on the substrate, and FIG. 7 is a magnified view of the micro-tip of FIG. 6. As shown in FIGS. 6 and 7, the micro-tip as a collection of nano-tips has nano-sized surface feature.

As a test result, the gate turn-on voltage of the FED fabricated by the method according to the present invention is reduced by about 20V, and the working voltage (a voltage level at a 1/90 duty ratio and a 60 Hz frequency) is lowered by about 40–50V, compared with a conventional FED. The height of the micro-tip and the size of the nano-tips can be varied by adjusting the etching ratios or etching rates of the carbonaceous polymer layer and the micro-tip during the plasma etching, as described previously. For example, the etch rates of the carbonaceous polymer layer and the micro-tip can be adjusted by varying the $O_2$-to-the etching gas for the micro-tip in a reaction gas used, plasma pressure, or plasma power during the etching process.

Figure 8:
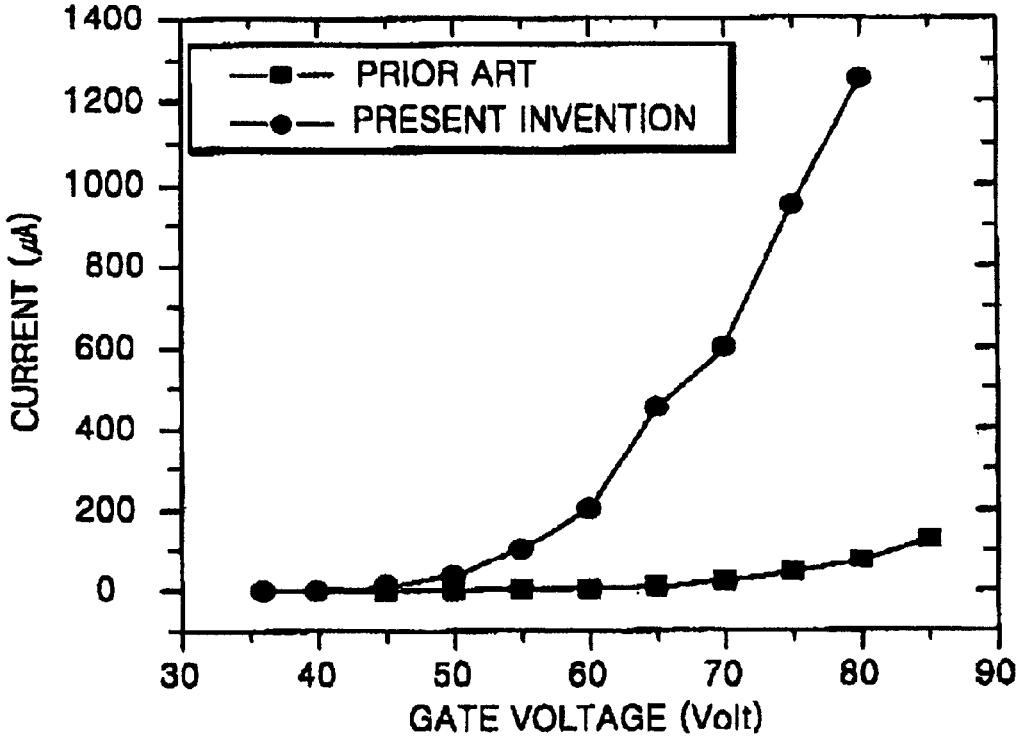
FIG. 8 is a graph comparatively showing the current-gate voltage characteristic of a conventional FED and the FED fabricated by the inventive method.

FIG. 8 is a graph comparatively showing the current-gate voltage characteristic of a conventional FED and the FED fabricated according to the present invention. As shown in FIG. 8, the current level of the inventive FED is higher than that of the conventional FED at the same gate voltage levels, and 10 times higher than that at the highest gate voltage.

Figure 9:
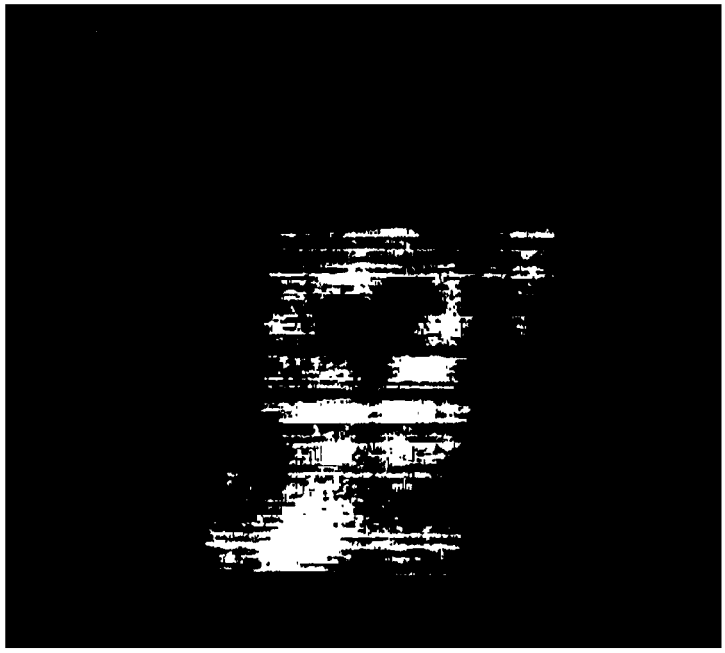
FIG. 9(PRIOR ART)
FIG. 9 is a front photo of the conventional FED with poor brightness uniformity.
Figure 10:
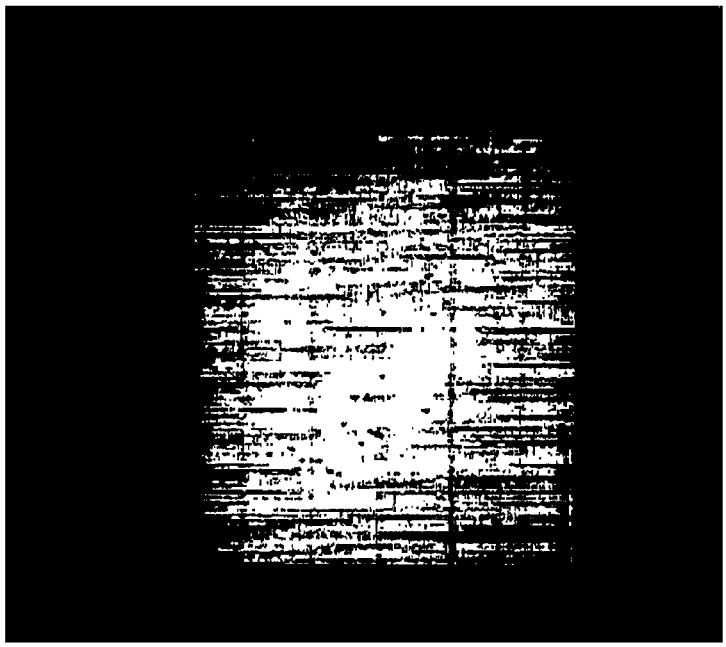
FIG. 10 is a front photo of the FED fabricated by the inventive method.

FIGS. 9 and 10, which are front photos of the conventional FED and the inventive FED taken with a digital camera, comparatively show the bright uniformity of the conventional FED and the inventive FED. As shown in FIGS. 9 and 10, the brightness uniformity of the FED according to the present invention is better than that of the conventional FED. The inventive FED shows the excellent brightness uniformity.

Unlike the conventional FED having the micro-tips with smooth surface, the FED according to the present invention, has the micro-tips with nano-sized surface features as a collection of a large number of nano-tips. The inventive FED has high emission current densities at low gate turn-on voltages, and thus the brightness of the FED is enhanced. In addition, occurrence of arcing in the FED is suppressed due to the reduced gate turn-on voltage level.

While this invention has been particularly shown and described with reference to preferred embodiments thereof, it will be understood by those skilled in the art that various changes in form and details may be made to the described embodiments without departing from the spirit and scope of the invention as defined by the appended claims.

What is claimed is:

1. A field emission device (FED) comprising:

a substrate;

a cathode formed over the substrate;

micro-tips having nano-sized surface features, each micro-tip, including the nano-sized surface features, being of a single homogenous material and, formed in electrical contact with the cathode;

a gate insulation layer with wells each of which a single micro-tip is located in, the gate insulation layer formed over the substrate; and a gate electrode with gates aligned with the wells such that each of the micro-tips is exposed through a corresponding gate, the gate electrode formed on the gate insulation layer.

2. The field emission device of claim 1, wherein a resistor layer is formed over or beneath the cathode, or a resistor layers are formed over and beneath the cathode.

3. A method for fabricating a field emission device (FED), comprising:

forming a cathode, a gate insulation layer with wells, and a gate electrode with gates on a substrate in sequence, and forming micro-tips on the cathode exposed by the wells;

forming a carbonaceous polymer layer on the gate electrode, such that the wells having the micro-tips are filled with the carbonaceous polymer layer; and etching the carbonaceous polymer layer and the surface of the micro-tips by plasma etching using a gas mixture containing $O_2$ for the carbonaceous polymer layer, and a gas for the micro-tips, as a reaction gas, so that the micro-tips with nano-sized surface features are formed wherein each micro-tip, including the nano-sized surface features, is of a single homogenous material.

4. The method of claim 3, wherein the carbonaceous polymer layer is formed of polyimide or photoresist.

5. The method of claim 3, wherein the carbonaceous polymer layer is etched by reactive ion etching (REI).

6. The method of claim 5, wherein the nano-sized surface features of the micro-tips are adjusted by varying the etch rates of the carbonaceous polymer layer and the micro-tips.

7. The method of claim 6, wherein the etch rates are adjusted by varying the oxygen-to-the gas for the microchips in the reaction gas, plasma power, or plasma pressure during the etching process.

8. The method of claim 5, wherein the micro-tips are formed of at least one selected from the group molybdenum (Mo), tungsten (W), silicon (Si) and diamond, and the reaction gas is a gas mixture of $O_2$ and fluorine-based gas.

9. The method of claim 8, wherein the reaction gas comprises $CF_4/O_2$, $SF_6/O_2$, $CHF_3/O_2$, $CF_4/SF_6/O_2$, $CF_4/CHF_3/O_2$, and $SF_6/CHF_3/O_2$.

10. The method of claim 5, wherein the micro-tips are formed of at least one selected from the group molybdenum (Mo), tungsten (W), silicon (Si) and diamond, and the reaction gas is a gas mixture of $O_2$ and chlorine-based gas.

11. The method of claim 10, wherein the reaction gas comprises $Cl_2/O_2$, $CCl_4/O_2$, and $Cl_2/CCl_4/O_2$.

12. A method of fabricating a field emission device (FED) comprising:

providing a substrate;

forming a cathode over the substrate;

forming micro-tips having nano-sized surface features on the cathode, wherein each micro-tip, including the nano-sized surface features, is of a single homogenous material;

providing a gate insulation layer with wells each of which a single micro-tip is located in, the gate insulation layer formed over the substrate; and providing a gate electrode with gates aligned with the wells such that each of the micro-tips is exposed through a corresponding gate, the gate electrode formed on the gate insulation layer.

13. The method of claim 12, further comprising forming a resistor layer over or beneath the cathode, or forming a resistor layers over and beneath the cathode.

14. A field emission device (FED) comprising:

a substrate;

a cathode formed over the substrate;

micro-tips having nano-sized surface features, wherein each micro-tip, including the nano-sized surface features, is of a single homogenous material, and formed in electrical contact with the cathode;

a gate insulation layer with wells each of which a single micro-tip is located in, the gate insulation layer formed over the substrate;

a gate electrode with gates aligned with the wells such that each of the micro-tips is exposed through a corresponding gate, the gate electrode formed on the gate insulation layer, wherein said micro-tips having nano-sized surface features is the product of a process of forming a carbonaceous polymer layer on the gate electrode, such that the wells having the micro-tips are filled with the carbonation polymer layer; and etching the carbonaceous layer and the surface of the micro-tips by plasma etching using a gas mixture $O_2$ for the carbonaceous polymer layer, and a gas for the micro-tips, as a reaction gas, so that the micro-tips with nano-sized surface features are formed.

15. The field emission device of claim 14, wherein a resistor layer is formed over or beneath the cathode, or resistor layers formed over and beneath the cathode.

* * * * *